US009706813B2

(12) United States Patent
Langvin et al.

(10) Patent No.: US 9,706,813 B2
(45) Date of Patent: Jul. 18, 2017

(54) SHOE WITH LACING STORAGE POCKET

(71) Applicant: Nike, Inc., Beaverton, OR (US)

(72) Inventors: Elizabeth Langvin, Beaverton, OR (US); Nadia Panian, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 76 days.

(21) Appl. No.: 14/730,023

(22) Filed: Jun. 3, 2015

(65) Prior Publication Data

US 2016/0353842 A1 Dec. 8, 2016

(51) Int. Cl.

| | |
|---|---|
| ***A43B 7/00*** | (2006.01) |
| ***A43C 7/02*** | (2006.01) |
| ***A43C 7/04*** | (2006.01) |
| ***A43C 7/00*** | (2006.01) |

(52) U.S. Cl.

CPC ..... *A43C 7/02* (2013.01); *A43C 7/005* (2013.01); *A43C 7/04* (2013.01); *Y10T 24/3708* (2015.01)

(58) Field of Classification Search

CPC .. A43C 7/02; A43C 7/04; A43C 7/005; A43B 23/26; A43B 3/0031; Y10T 24/3708; Y10T 37/3713; Y10T 24/3716

USPC ..... 36/54

See application file for complete search history.

(56) References Cited

U.S. PATENT DOCUMENTS

| | | | | |
|---|---|---|---|---|
| 4,372,060 | A | 2/1983 | Adamik | |
| D281,925 | S | 12/1985 | Gamm | |
| 4,630,383 | A * | 12/1986 | Gamm | A43B 3/0031 36/134 |
| 4,805,321 | A | 2/1989 | Tonkel | |
| D305,178 | S | 12/1989 | Tonkel | |
| 5,042,119 | A | 8/1991 | Williams | |
| 5,094,016 | A * | 3/1992 | DiVito | A43B 1/0036 36/1 |
| 5,311,679 | A * | 5/1994 | Birch, Sr. | A43B 3/0031 2/919 |
| 5,778,500 | A * | 7/1998 | Illingworth | A43C 7/00 24/712 |
| 6,449,881 | B1 * | 9/2002 | Assaf | A43B 3/0031 150/143 |
| 6,473,999 | B2 | 11/2002 | Fellouhe | |
| 6,532,688 | B2 | 3/2003 | Bouvier | |
| 6,588,078 | B2 * | 7/2003 | Writt | A43B 3/0031 24/712.2 |
| 6,785,983 | B2 | 9/2004 | Challe | |

(Continued)

FOREIGN PATENT DOCUMENTS

| | | |
|---|---|---|
| CN | 202722659 | 2/2013 |
| DE | 8810872 | 2/1989 |

(Continued)

*Primary Examiner* — Jila M Mohandesi

(74) *Attorney, Agent, or Firm* — Wissing Miller LLP

(57) ABSTRACT

A shoe having a sole and an upper including a tongue, secured to the sole, a row of eyelets along each side of the tongue, including topmost eyelets and foremost eyelets, and a pocket accessory which includes a pocket member that has an anchor portion and a pocket flap which defines a pocket for receiving the knotted shoe lace via a pocket opening. There may be a cover member attached to the shoe, which can removably engage the pocket member to cover or expose the pocket opening. The pocket member may be sewn to the tongue of the shoe or attached thereto otherwise.

18 Claims, 2 Drawing Sheets

(56) References Cited

U.S. PATENT DOCUMENTS

| | | | | |
|---|---|---|---|---|
| 6,895,696 | B1 | 5/2005 | Sanders | |
| D507,861 | S | 8/2005 | Kim | |
| 6,988,298 | B2 * | 1/2006 | Ternasky ..... | A43B 3/0078 24/306 |
| 7,640,640 | B1 | 1/2010 | Watkins | |
| 2003/0093918 | A1 | 5/2003 | Challe | |
| 2005/0081403 | A1 | 4/2005 | Mathieu | |
| 2011/0000105 | A1 | 1/2011 | Ueda et al. | |
| 2013/0205618 | A1 | 8/2013 | Martigay | |

FOREIGN PATENT DOCUMENTS

| | | |
|---|---|---|
| EP | 0923886 | 4/2002 |
| JP | 2007330466 | 12/2007 |

* cited by examiner

SHOE WITH LACING STORAGE POCKET

BACKGROUND

Field

The present disclosure relates generally to footwear, and more particularly to athletic shoes.

Description of the Related Art

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces, the sole structure may provide traction and control potentially harmful foot motion, such as over pronation. Accordingly, the upper and the sole structure operate cooperatively to provide a comfortable structure that is suited for a wide variety of ambulatory activities, such as walking and running.

The upper forms a void within the shoe for receiving the foot. The void has the general shape of the foot, and access to the void is provided by an ankle opening. Typically, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

Various materials may be utilized in manufacturing the upper. The upper of an article of athletic footwear, for example, may be formed from a single layer of material or multiple material layers that include, e.g., an exterior layer, a middle layer, and an interior layer. The materials forming the exterior layer of the upper may be selected based upon the properties of wear-resistance, flexibility, and air-permeability, for example. With regard to the exterior layer, the toe area and the heel area may be formed of leather, synthetic leather, or a rubber material to impart a relatively high degree of wear-resistance even when such materials are not used elsewhere on the upper due to their relatively low degree of flexibility and air-permeability. Accordingly, various other areas of the exterior layer of the upper may be formed from other materials, e.g., natural or synthetic textiles. The exterior layer of the upper may be formed, therefore, from numerous material elements that each impart different properties to specific areas of the upper.

A middle layer of the upper may be formed from a lightweight polymer foam material that attenuates ground reaction forces and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

The sole structure provides an outsole and may optionally incorporate multiple layers that are conventionally referred to as an insole, a midsole, in addition to the outsole. The insole is a thin, comfort-enhancing member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and attenuating ground reaction forces. The outsole forms the ground-contacting element of footwear and is usually fashioned from a durable, wear-resistant material that includes texturing to improve traction.

Generally, wrestling shoes are worn to offer wrestlers improved traction and ankle support and protection to toes and skin, without inhibiting the flexibility of the wrestler's feet and ankles. In these ways, wrestling shoes serve to improve performance and prevent or reduce injury and disease. A typical wrestling shoe, like many other athletic shoes, has an upper that is split in the front defining two edges of the upper, each provided with a row of eyelets so that the wearer can employ lacing threaded through the eyelets to releasably secure the shoe to the wearer's foot. There is also typically a tongue extending from the vamp portion of the shoe and positioned to rest between the wearer's foot and the eyelet regions of the upper to protect the foot from abrasion from the lacing and from the edges of the upper.

U.S. Pat. No. 7,640,640 to Watkins discloses a shoelace containment device which attaches to a shoe by means of a strap which wraps around a portion of the shoelace between eyelets. The device includes a pocket 12 to which a closure flap 13 is attached via a hinge 14. The shoelace is tied in a knot on top of the device and the loops and end of the tied lace is inserted into the pocket, and the closure flap is folded over to enclose the ends of the lace in the pocket.

BRIEF SUMMARY

The present disclosure discloses a pocket accessory for a shoe, for enclosing the knot, loops and ends of a shoelace when the shoelace is tied to secure a shoe to a wearer's foot.

According to one illustrative embodiment, there is provided a shoe comprising a sole and an upper secured to the sole. The upper includes a tongue and a row of eyelets along each side of the tongue, each row of eyelets including a topmost eyelet and a foremost eyelet. The shoe has a toe portion and a heel portion, and there is a pocket accessory on the upper, e.g., on the tongue. The pocket accessory includes a pocket member having an anchor portion and a pocket flap, the pocket flap defining a pocket having a pocket opening which is positioned between the rows of eyelets.

According to one aspect, the pocket accessory may have a pocket opening positioned between the topmost eyelets. Optionally, the pocket opening may have a T-shaped configuration including a cross-wise portion and a stem portion.

According to another aspect, there may also be a cover member having a mounting portion and a cover flap, the mounting portion being secured to the tongue at a point below the pocket opening. The cover flap is flexibly joined to the mounting portion, whereby the cover flap can be disposed against the pocket flap to cover the pocket opening and can be pivoted away from the pocket flap to expose the pocket opening.

In another aspect, the mounting portion may be secured to the tongue at the anchor position.

According to still another aspect, the pocket flap has a front surface and the cover flap has a back surface, and optionally, the pocket flap front surface and the cover flap back surface are configured to releasably engage each other.

According to another optional aspect, the cover flap may be configured to cover the opening in the pocket flap when the cover flap is disposed against the pocket flap.

In various embodiments, the anchor portion may be fixedly attached to the tongue while the pocket flap is releasably attached to the tongue; or, the anchor portion may be releasably attached to the tongue and the pocket flap is fixedly attached to the tongue; or, the pocket accessory is releasably attached to the tongue, e.g., at both the anchor portion and the pocket flap.

According to another aspect, this disclosure provides a shoe pocket accessory for a shoe. The shoe pocket accessory comprises a pocket member which comprises a pocket flap and an anchor portion, the pocket flap being formed from a pliable material and defining a front surface and a pocket having a pocket opening on the front surface, and the pocket member further having a top edge. There is also a cover member having a mounting portion and a cover flap, and the mounting portion is secured to the anchor portion. Optionally, the cover flap has a back surface are configured to releasably engage the pocket flap front surface.

In one embodiment, the pocket flap may have a top edge opposite from the anchor portion and the pocket opening is between the top edge and the anchor portion.

Optionally, the pocket member is configured for releasable engagement with a shoe.

BRIEF DESCRIPTION OF THE DRAWINGS

The figures depict embodiments for purposes of illustration only. One skilled in the art will readily recognize from the following description that alternative embodiments of the structures and methods illustrated herein may be employed without departing from the principles described herein, wherein.

DETAILED DESCRIPTION

This disclosure describes a pocket accessory for athletic shoes, and such shoes improved with such a pocket accessory for optional but preferred use in wresting ("wrestling shoes"), or shoes for other activities. The pocket accessory is attached to the tongue of the shoe. The concepts disclosed with respect to shoe 10 may, however, be applied to shoes that are specifically designed for a wide range of other athletic activities, including basketball, baseball, football, soccer, walking, and hiking, or may be applied to various non-athletic shoes.

Figure 1:
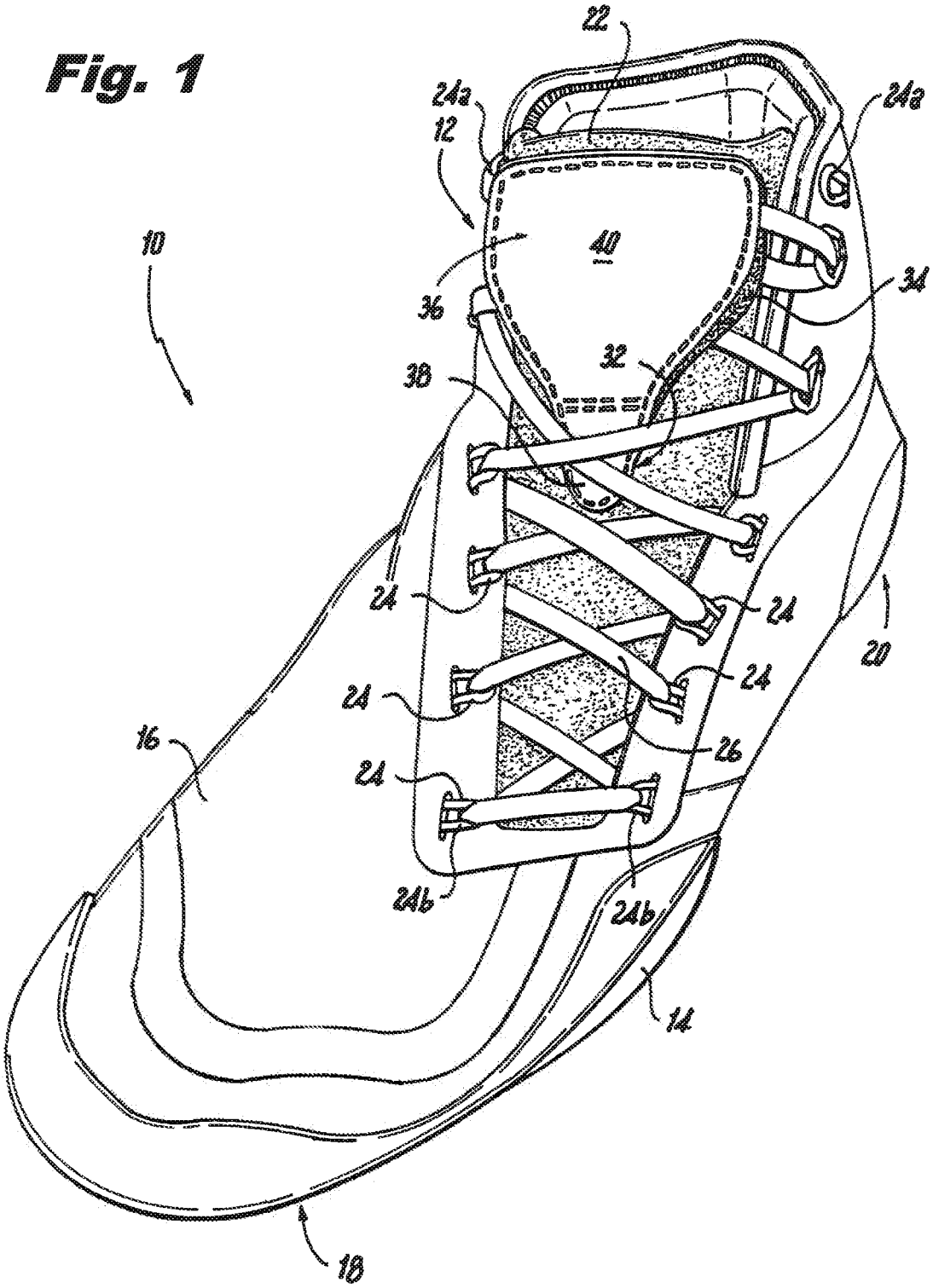
FIG. 1 is a perspective view of a wresting shoe equipped with a pocket accessory according to one embodiment of the disclosure.

There is shown in FIG. 1 a representative shoe 10 equipped with a pocket accessory 12 according to an illustrative embodiment of this disclosure. The shoe 10 comprises a sole 14 and an upper 16 secured to the sole. The shoe 10 has a toe portion 18 and a heel portion 20. As used herein to describe relative positions and directions in relation to the shoe 10, "forward," "front" and "lower" mean toward the toe, "back" or "rearward" mean toward the heel, and "up," "upward" and "higher" mean toward the top of the shoe, away from the sole.

The upper 16 is open at the front to facilitate insertion of the wearer's foot, and includes a tongue 22 and rows of eyelets 24 along each side of the opening, each row of eyelets including an upward-most pair of eyelets 24*a* and a lowermost pair of eyelets 24*b*, with one eyelet of each pair on one side of the opening of the upper. The shoe 10 includes a lace 26 which is threaded through the eyelets 24.

The pocket accessory 12 comprises a pocket member 30 (see FIG. 2) which includes an anchor portion 32 and a top edge 30*a*. The pocket member 30 is fixedly attached to the tongue 22 at the anchor portion 32 of the pocket member and also near the top edge 30*a*, e.g., the anchor portion 32 and the top edge 30*a* may be sewn to the tongue or may be fixedly attached by any other suitable method.

Figure 2:
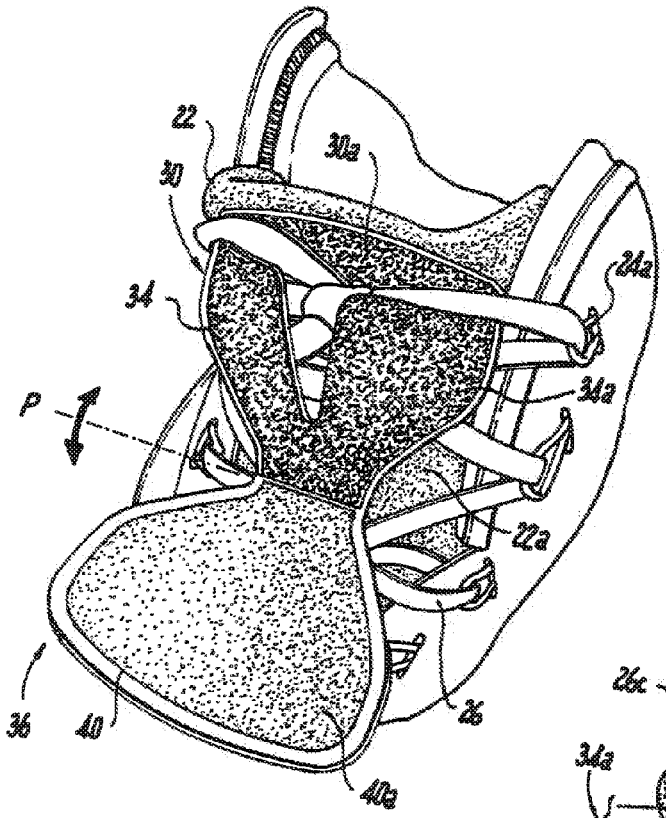
FIG. 2 is a perspective view of a wresting shoe of FIG. 1 with the cover flap of the accessory retracted.
Figure 3:
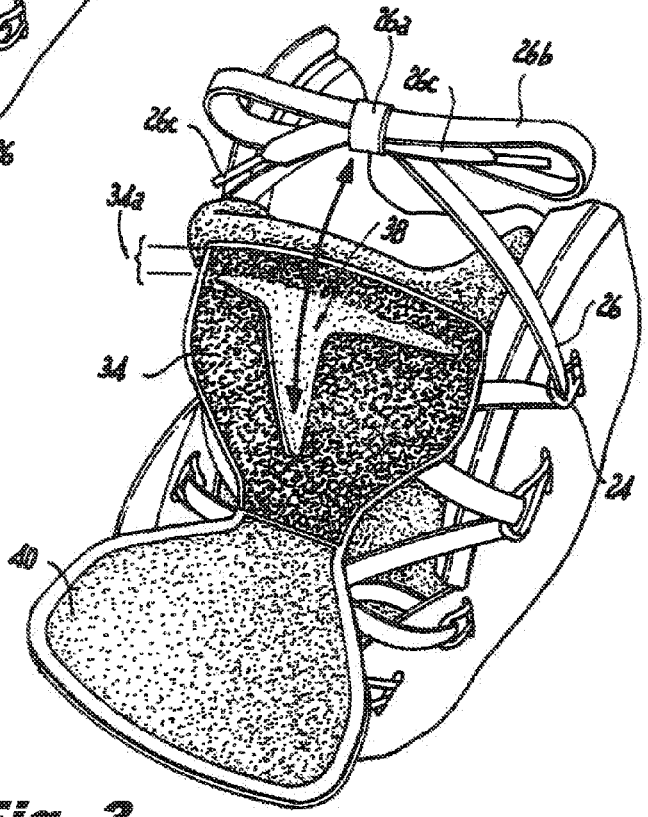
FIG. 3 is a perspective view of the wresting shoe of FIG. 2 with the lace knot in an elevated position to allow an indication of how the accessory is used.

The pocket flap 34 is made from a pliable fabric and defines a pocket. As seen in FIG. 2 and FIG. 3, the pocket flap 34 has a pocket opening 38. The pocket opening 38 is positioned near the top edge 30*a* of the pocket member 30 but this is not a limitation on the disclosure and in other embodiments, the pocket opening may be positioned lower on the pocket flap. In one embodiment, the pocket opening 38 is disposed between the upward-most pair of eyelets 24*a* for use by a wearer who chooses to lace the shoe 10 all the way to the upward-most eyelets. However, this is not a limitation on the disclosure and in other embodiments, a pocket opening may be positioned between other pairs of eyelets on the upper 16, in case a wearer prefers to lace the shoe only part way up.

As seen in FIG. 2 and FIG. 3, the opening 38 has a T-shaped configuration, i.e., it has a stem portion extending from between the ends of a cross-wise portion, and the opening is oriented such that the cross-wise portion is between the upward-most pair of eyelets 24*a* and the step portion is extending downward from the cross-wise portion.

Another optional feature shown in FIG. 2 and FIG. 3 is that the upper-most portion of the opening 38 is spaced from the top of the pocket flap 34, leaving a top margin 34*a* of the pocket flap above the pocket opening.

Being pliable, the pocket flap 34 can be disposed flat against the tongue 22 and can be lifted away from the tongue while the anchor portion 32 and top edge 30*a* remain attached to the tongue, thus opening a passage through which laces may be passed to permit the user to lace the shoe 10. Once the shoe is laced up to eyelets aligned with the pocket opening, the user tightens the lace and ties the ends of the lace, typically in a knot 26*a* leaving loops 26*b* and loose ends 26*c* dangling. The knot 26*a* can rest against the pocket flap 34 and the user can then easily push the knot, the loops 26*b* and loose ends 26*c* through the pocket opening 38 and into the pocket as shown in FIG. 2 and FIG. 3.

Having one or more of the knot 26*a*, loops 26*b* and loose ends 26*c* in the pocket of the pocket flap 34 serves to prevent the knot from coming untied as a result of contact with other things, as may occur as the wearer engages in sporting activity. In addition, keeping the knot and the loose ends of the lace in the pocket helps prevent injury to the wearer, and potentially to others (e.g., wrestling opponents) from abrasions and/or puncture wounds from the knot or from aglets on the laces.

The pocket accessory 12 includes an optional cover member 36 having a mounting portion 38 and a cover flap 40. The mounting portion 38 is optionally secured to the shoe 10 at the anchor position, fixedly or releasably, e.g., the mounting portion may fixedly secured by being sewn onto the anchor portion of the pocket member 30, and therefore secures the cover member 36 to the shoe 10. In other embodiments, the mounting portion 38 of the cover member may be secured elsewhere on the pocket member 30, e.g., at a point higher up on the pocket member 30 than the anchor position; or, the mounting portion may be secured on the tongue 22 at a location below the anchor position. In one embodiment, the cover flap 40 is pliable so that the cover flap can be disposed against the pocket flap 34 and can be lifted away from the pocket flap as well. Alternatively, or in addition, the cover flap 40 may be pivotably attached to the pocket member 30 about an axis p (FIG. 2). The pocket flap 34 has a front surface 34*a* and the cover flap 40 has a back surface 40*a*, and the pocket flap front surface and the cover flap back surface are configured to releasably engage each other, e.g., by a snap-connector, VELCRO®-type hook and loop engagement, or the like.

As seen in FIG. 1, the cover flap 40 is configured so that when disposed against the pocket flap 34, the cover flap 40 covers the opening 38 to the pocket flap. Covering the opening 38 helps to prevent the lace knot, loops and/or loose ends from slipping out from the pocket in the pocket flap 34. This protective effect is enhanced if the pocket flap 34 has a top margin 34*a* over the pocket opening 38 and the cover flap 40 is configured to engage the top margin.

In use, the user laces the shoe, lifting the pocket accessory 12 away from the tongue 22 to pass laces between the pocket member 30 and the tongue. The user then ties the lace 26 into a knot 26*a* which then rests against the pocket member 30, and the user pushes the knot, loops 26*b* and loose ends 26*c* into the opening 38 of the pocket. If there is a cover flap 40, the user then engages the cover flap with pocket flap 34 to cover the opening 18. Later, to untie and remove the shoe 10, the user lifts the cover flap 40 away from the pocket flap 34, removes the knot 26*a* etc. from the pocket, unties the knot in the lace 26, and can then loosen and remove the shoe 10.

Optionally, one or both of the pocket flap 34 (e.g. near the top edge 30*a*) and the anchor portion 32 is releasably engaged with the tongue 22, i.e., easily detached from the tongue and then re-attached without the need for adding new attachment means. For example, releasable engagement can be achieved using a snap closure or a VELCRO®-type hook and loop engagement between the tongue 22 and the pocket flap 34 or the anchor portion 32 of the pocket member 30. If, for example, the top edge 30*a* is releasably attached to the tongue 22, the user may lift the pocket member 30 away from the tongue for ease in lacing the shoe, and then re-attach the top edge 30*a* to the tongue while tying the lace and then inserting the knot into the pocket. If the anchor portion 32 is releasable from the tongue 22, it would be possible to lift the pocket member away from the tongue for ease in lacing the shoe, and then re-attach the anchor portion to the tongue while tying the lace and then inserting the knot into the pocket. If both the anchor portion 32 and the pocket flap 34 are releasably attached, the user may remove the pocket accessory 12 from the shoe, lace the shoe without the pocket accessory 12 thereon, and then attach the pocket accessory after the lace 26 is threaded through all the desired eyelets 24. Also, using the VELCRO® method, the wearer may detach and re-attach the pocket accessory 12 to move it up or down on the tongue 22 to position the pocket opening 38 at any desired point along the rows of eyelets 24. As a detachable accessory, the pocket accessory 12 may be manufactured and sold independently of the shoe 10, and then used therewith.

It will be understood that while the foregoing description is for a single shoe for one foot, the same features can be provided in a mirror image shoe for the wearer's other foot. Moreover, while the present disclosure describes various embodiments of a pocket accessory, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the disclosure as defined by the claims appended hereto.

What is claimed is:

1. A shoe comprising:

a sole;

an upper secured to the sole, the upper including a tongue and a row of eyelets along each side of the tongue, each row of eyelets including a topmost eyelet and a foremost eyelet; and a pocket accessory on the tongue, the pocket accessory including a pocket member and a cover member, wherein the pocket member comprises, a top edged attached to the tongue, an anchor portion spaced from the top edge and attached to the tongue, and a pocket flap between the top edge and the anchor portion, the pocket flap defining a pocket, the pocket having a pocket opening which is positioned between the rows of eyelets, and wherein the cover member comprises a mounting portion and a cover flap, the mounting portion being attached to the anchor portion at a point below the pocket opening, and the cover flap being flexibly joined to the mounting portion such that the cover flap can be disposed against the pocket flap to cover the pocket opening and can be pivoted away from the pocket flap to expose the pocket opening.

2. The shoe according to claim 1 wherein the pocket opening is positioned between the topmost eyelets of each row of eyelets.

3. The shoe according to claim 2 wherein the pocket opening has a T-shaped configuration including a cross-wise portion and a stem portion.

4. The shoe according to claim 3 wherein the pocket opening is situated with the cross-wise portion extending between the rows of eyelets and with the stem portion extending toward the anchor portion.

5. The shoe according to claim 1 wherein the mounting portion is secured to the tongue at the anchor portion.

6. The shoe according to claim 1 wherein the pocket flap has a front surface and the cover flap has a back surface, and wherein the pocket flap front surface and the cover flap back surface are configured to releasably engage each other.

7. The shoe according to claim 1 wherein the anchor portion and the cover flap are fixedly attached to the tongue.

8. The shoe according to claim 1 wherein the anchor portion is fixedly attached to the tongue and the cover flap is releasably attached to the anchor portion.

9. The shoe according to claim 1 wherein the anchor portion is releasably attached to the tongue and the cover flap is fixedly attached to the anchor portion.

10. The shoe according to claim 1 wherein the pocket accessory is releasably attached to the tongue.

11. A shoe comprising:

a sole;

an upper secured to the sole, the upper including a tongue and a row of eyelets adjacent each side of the tongue, each row of eyelets including a topmost eyelet and a foremost eyelet; and a pocket accessory including a pocket member and a cover member, wherein the pocket member comprises:

a top edged attached to the tongue;

an anchor portion spaced from the top edge and attached to the tongue; and a pocket flap between the top edge and the anchor portion, the pocket flap defining a pocket having a pocket opening positioned between the topmost eyelets of each row of eyelets;

and wherein the cover member comprises:

a mounting portion secured to the anchor portion at a point below the pocket opening; and a cover flap flexibly attached to the mounting portion such that the cover flap can be moved between a closed position and an open position, wherein when in the closed position the cover flap covers the pocket opening and releasably attaches the cover flap to the pocket member, and wherein when in the open position the pocket opening is exposed.

12. The shoe according to claim 11 wherein the pocket flap has an elongated opening such that the pocket opening has a T-shaped configuration including a cross-wise portion and a stem portion.

13. The shoe according to claim 12 wherein the pocket opening is situated with the cross-wise portion extending between the topmost eyelets of each row of eyelets and with the stem portion extending toward the anchor portion.

14. The shoe according to claim 11 wherein the pocket flap has a front surface and the cover flap has a back surface, and wherein the pocket flap front surface and the cover flap back surface are configured to releasably attach to each other when the cover flap is in the closed position.

15. The shoe according to claim 11 wherein the anchor portion and the cover flap are fixedly attached to the tongue.

16. The shoe according to claim 11 wherein the anchor portion is fixedly attached to the tongue and the cover flap is releasably attached to the anchor portion.

17. The shoe according to claim 11 wherein the anchor portion is releasably attached to the tongue and the cover flap is fixedly attached to the anchor portion.

18. The shoe according to claim 11 wherein the pocket accessory is releasably attached to the tongue.

* * * * *